United States Patent [19]

Cota

[11] Patent Number: 4,763,115

[45] Date of Patent: Aug. 9, 1988

[54] FIRE OR SMOKE DETECTION AND ALARM SYSTEM

[75] Inventor: Albert O. Cota, Granada Hills, Calif.

[73] Assignee: Donald L. Trigg, Chatsworth, Calif.

[21] Appl. No.: 939,537

[22] Filed: Dec. 9, 1986

[51] Int. Cl.[4] ..... G08B 17/00; G08B 7/00

[52] U.S. Cl. ..... 340/628; 340/691; 340/586; 340/521

[58] Field of Search ..... 340/628, 630, 691, 577, 340/594, 521, 693, 586, 584, 506; 250/372

[56] References Cited

U.S. PATENT DOCUMENTS

| | | | |
|---|---|---|---|
| 3,943,499 | 3/1976 | Dunphy | 340/586 X |
| 3,980,997 | 9/1976 | Berns et al. | 340/630 |
| 4,016,424 | 4/1977 | Traira | 250/372 |
| 4,074,225 | 2/1978 | Vandeweghe | 340/577 X |
| 4,151,522 | 4/1979 | Yamauchi | 340/628 X |
| 4,241,258 | 12/1980 | Cholin | 250/372 |
| 4,260,984 | 4/1981 | Honama | 340/630 |
| 4,283,657 | 8/1981 | Gordon et al. | 340/628 X |
| 4,388,617 | 6/1983 | Nakonishi et al. | 340/584 X |
| 4,489,308 | 12/1984 | Logan, Jr. et al. | 340/628 X |
| 4,521,645 | 6/1985 | Carroll | 340/628 X |
| 4,524,304 | 6/1985 | Todd | 340/628 X |
| 4,531,114 | 7/1985 | Topol et al. | 340/628 X |
| 4,673,920 | 6/1987 | Ferguson et al. | 340/506 X |

*Primary Examiner*—Joseph A. Orsino
*Assistant Examiner*—Tat K. Wong
*Attorney, Agent, or Firm*—Albert O. Cota

[57] ABSTRACT

A fire or smoke detection and alarm system (10) that is enclosed in an elongated enclosure (36) and installed alongside an exit door (52). The enclosure (36) includes a first circuit (12) having integral smoke and fire detectors (14*a*), (16*a*) and a redundant second circuit (20) having an integral sound activated switching circuit (22) that is energized by a pre-existing remote audio alarm (24*a*). The two circuits (12), (20) may be selected either manually by a toggle switch (28) or automatically by an automatic switching circuit (30). When either of the two circuits are energized by smoke or fire, a stroboscopic flashing lamp (34*a*) and an audio alarm (34*b*) that are located near the bottom of the enclosure (36), are turned-on. When a fire occurs and smoke fills a room or corridor, panic and disorientation are common. By having the lamp (34*a*) and audio alarm (34*b*) near the floor, a person can crouch and be guided by the beam of the light and sound toward the exit door and out to ultimate safety.

2 Claims, 2 Drawing Sheets

FIRE OR SMOKE DETECTION AND ALARM SYSTEM

TECHNICAL FIELD

The invention pertains to the general field of fire or smoke detectors and alarm systems and more particularly to a system that incorporates a pair of fire or smoke detection circuits that operate a light and audio alarm. The entire system is housed in an enclosure that is attached alongside an exit to allow persons in a smoke filled area to find the exit by following the beam of light and sound.

BACKGROUND ART

Fire and smoke detectors and alarm systems have been in use in both homes and commercial buildings for a number of years. Most current systems employ primarily an audio alarm. The alarm is normally located on the ceiling or on an upper section of a wall and is designed to emit an audio sound that is omni-directional. Some systems also include a light that illuminates when the audio alarm is energized. The light is generally located centrally within the alarmed building.

One of the problems with most existing alarm systems is that they are designed to only alert occupants in a home or building that a fire exits without directing the occupants to the nearest emergency exit. The need for fire exit direction is especially important when a room and hallway is filled with dense smoke. Under these conditions a person can easily become disoriented due to unfamiliarity with surroundings and/or panic which occurs frequently under emergency situations.

An additional problem with current systems is that in most buildings and especially single dwelling homes, only a single alarm system is used. Therefore, if there should be a detector and/or alarm malfunction, a potentially catastrophic situation could occur. The problem is further compounded with systems that operate with only one source of power.

A search of the prior art did not disclose any patents that read directly on the claims of the instant invention however, the following U.S. patents were considered related:

| U.S. PAT. NO. | INVENTOR | ISSUED |
|---|---|---|
| 4,148,023 | Elkin | 3 April 1979 |
| 3,969,702 | Nishino | 13 July 1976 |
| 2,982,949 | Pivetz | 2 May 1961 |

The Elkin patent discloses an emergency exit indicator. The indicator includes, in part, a smoke detector, a high intensity lamp and a horn. The lamp and horn are physically located near a door opening and are connected through a power switching circuit to an a-c power source. When smoke is detected by the detector, the switching circuit is energized which in turn, causes the power source to switch and apply power to the lamp and horn. The lamp and horn remain energized until the switching circuit is manually reset.

The Nishino patent discloses an emergency alarm and evacuation system for indicating the direction and location of an emergency exit. The system includes, in part, a smoke detector, an operating unit and a plurality of indicator units that are arranged in line toward the emergency exit. The indicator units include both a lamp and an audible alarm. When smoke is detected by the detector, an electrical output signal is applied through the operating unit that subsequently energizes the plurality of the indicators leading to the exit.

The Pivetz patent discloses a portable thermal alarm and signal system. The system is designed to operate on either 115 V-ac utility power or a battery and includes, in part, a light bulb, an audible alarm and a bi-metallic blade switch in series with the power circuit. The bulb and alarm are energized when the bi-metallic blade senses heat and its contacts close to complete the power circuit. The system also includes a mechanical method that allows the bi-metallic switch to be adjusted to allow the switch to close at a selected temperature.

DISCLOSURE OF THE INVENTION

The smoke and fire detection and alarm system has as its primary object to alert person in a home, school, hotel or other commercial building that there is a fire and to guide those persons to a fire exit. The system alarm consists of both an audio alarm that emits a high db sound level and a high intensity flashing stroboscopic lamp. Both alarms are located near the bottom section of an elongated enclosure that is attached vertically to a wall alongside a fire exit.

When a fire occurs, in many instances, the room or corridor becomes filled with dense smoke. Under these conditions a person, due to unfamiliarity with the surroundings and/or panic, can easily become disoriented and confused as to which way the nearest fire exit is located. Since smoke fills an enclosed area from the top down, instinctively a person will crouch or crawl to avoid the upper stratification of smoke. Therefore, by locating the lamp on the enclosure near the floor, a person can be led to a fire exit by following a path towards the beam of light and sound. Thus, the probability of a person finding the fire exit in a smoke obscured area is greatly improved.

The system includes within the elongated enclosure two independent and redundant fire or smoke detection circuits to increase the system reliability.

The first fire or smoke detection circuit is self-sufficient, that is, all the elements comprising the circuits are contained within the enclosure. The redundant second fire or smoke detection circuit consists of an integral sound activated switching circuit that is energized by a pre-existing remote fire/smoke detection circuit that includes a remote audio alarm. When this remote audio alarm is turned-on the sound level emitted energizes the sound activated switching circuit. Both of these circuits are connected to a common load circuit that consists of the lamp and audio alarm. Thus, if one of the fire or smoke detection circuits should become inoperative, the other circuit would provide the required signals to energize the alarms.

To further increase system reliability, the system is designed to be operated by either 115 V a-c household utility power or by a 24 V d-c battery. The household utility power operates a power source that consists of a regulated d-c power supply that produces the required 24 V d-c power and that includes a charging circuit that maintains the battery in a charged condition. Thus, if there should be a failure in the household utility power, the battery automatically takes over to provide the required system power.

The system also features two modes for controlling the operation of the two fire or smoke detecting circuits—a manual mode and an automatic mode. In the manual mode a key-operated circuit selection switch can be manually positioned to allow selection of either the first or the second circuit. This switch is also used to disable the circuits during routine maintenance and/or inspection periods.

In the automatic mode, the switch is replaced by a pair of diodes that function as an "OR" gate. When in the automatic mode, the lamp and audio alarm are energized by either of the two fire or smoke detecting circuits.

The common output circuit includes a silicon controlled rectifier (SCR) that is latched (turned-on) by a final SCR trigger signal that results from either a first, second or third SCR trigger signal that is produced by the fire or smoke detecting circuits. The cathode of the SCR is connected to circuit ground while the anode is connected across the lamp and audio alarm loads, through an SCR reset switch and on to the power source. Thus, when the SCR is turned on by the application of the final SCR trigger signal, the load circuit is energized. The SCR reset switch is used to re-set the system after a fire episode is over.

In addition to the primary object of having a fire or smoke detecting system so located that when energized, a person in a smoke filled area can find a fire exit, it is also an object to have a system that:

can be modified to allow the detector head to be removed from the enclosure and located on a ceiling or wall to conform to local fire codes, includes a load circuit that can easily accommodate additional loads, has sufficient internal and external space to allow for modifications if so needed, has an enclosure that can also be mounted in either a vertical or a horizontal position, can be modified to include an ultrasonic or infrared motion detector to allow the system to also function as an intrusion warning device, and is reliable in terms of Mean-Time-Between-Failure (MTBF) and is easily maintained.

BEST MODE FOR CARRYING OUT THE INVENTION

Figures 1, 2:
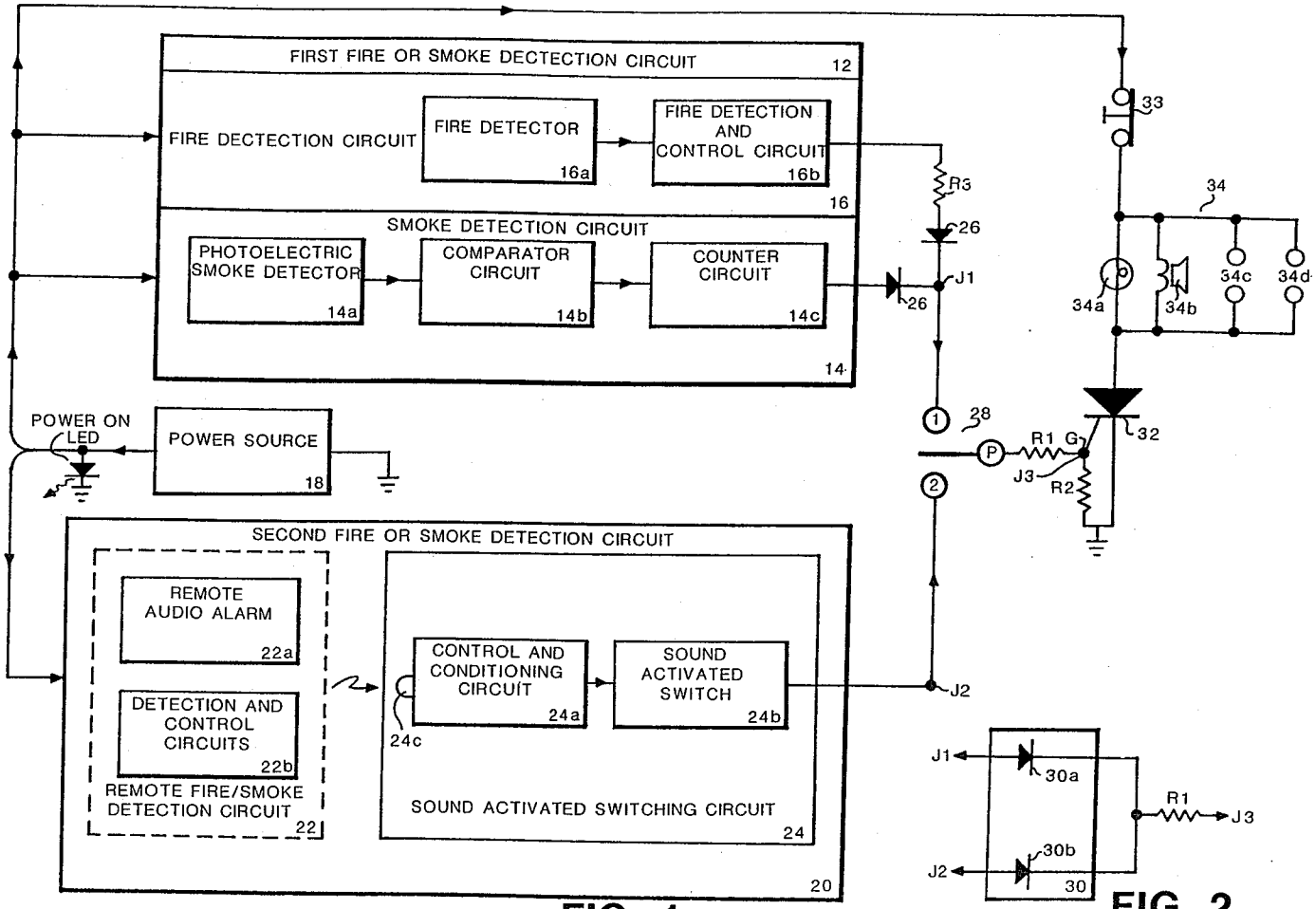
FIG. 1 is a combination block diagram and schematic of the overall fire or smoke detection and alarm system.
FIG. 2 is a schematic of the automatic circuit selection device.

The best mode for carrying out the invention is presented in terms of a preferred and a second embodiment. Both embodiments of the fire or smoke detection and alarm system 10 are primarily designed to allow a person(s) in a smoke filled room or corridor to find an exit by following a beam of light and sound which emanates from a light and audio alarm that are located in an enclosure that is attached alongside the exit.

The preferred embodiment, as shown in FIGS. 1 through 4 is comprised of the following fourteen major elements: a first fire or smoke detection circuit 12; a smoke detection circuit 14; a fire detection circuit 16; a power source 18; a second fire or smoke detection circuit 20; a remote fire/smoke detection circuit 22; a sound activated switching circuit 24; a pair of isolation diodes 26; a manually operated circuit selection switch 28; an automatic circuit selection device 30; a silicon controlled rectifier (SCR) 32; an SCR reset switch 33; a load circuit 34; and an elongated enclosure 36.

The first fire or smoke detection circuit 12 is comprised, as shown in FIG. 1, of the smoke detection circuit 14 and the fire detection circuit 16. Thus, allowing either the smoke or the heat from a fire to be detected and subsequently alarm the occupants of a home or building.

The smoke detection circuit 14, in the preferred embodiment, is comprised of a photoelectric smoke detector **14*a*, a comparator circuit 14*b* and a counter circuit 14*c***. The detector, which functions on the principle of light-reflecting smoke-detection, has a smoke chamber that incorporates a light source, such as a light emitting diode (LED), that is mounted on one side of the chamber and a photodiode that is mounted on the other side of the chamber. The photodiode is not exposed to the direct light of the LED. Thus, in the absence of smoke the photodiode is inactive since it receives little or no reflected light. Additionally, since the photodiode can detect small changes in light, it is liable to be affected by other light sources entering the smoke chamber and trigger a false detector signal. To prevent this occurrence, the smoke chamber is constructed in a baffled, labyrinth design to prevent unwanted external light from entering the smoke chamber.

During a fire, when smoke enters the smoke chamber, the light beam from the LED is reflected by the smoke blanket and is received by the photodiode. Upon receiving this light beam the smoke detector **14*a* produces a detector signal that is applied to the comparator circuit 14*b***.

The comparator is adjusted to produce a comparator signal when a preset alarm level is attained. This alarm level is set in accordance with established standards regulated in the United States of America by the individual States or by standards regulated by foreign countries. Under normal conditions (no fire present) the comparator signals are too narrow to activate the counter circuit **14*c***.

The counter circuit **14*c* is designed to be activated and produce a first SCR trigger signal when three consecutive comparator signal counts are received from the comparator 14*b***. Under normal conditions, noise may cause a single comparator signal to occur and be sent to the counter. However, if this first count is not followed by a second and third count within a preset period, usually two to three seconds, the counter will be reset. By requiring that three counts appear within a specified time, most false alarms are eliminated.

Under a fire environment, when the comparator **14*b* reaches the required alarm level and three counts are received by the counter 14*c***, the counter will produce the first SCR trigger signal. The routing and function of the first SCR trigger signal is described infra.

The fire detection circuit 16 is comprised of a fire detector **16*a* and a fire detection and control circuit 16*b*. The fire detector may be either an ultraviolet fire detector, a bi-metallic junction or any other type of fire detecting means that produces a fire detecting signal when fire is sensed. The fire detecting signal is applied to the fire detection and control circuit 16*b*** where the signal is converted to the second SCR trigger signal by conventional means well known in the art. The routing and function of the second SCR trigger signal is described infra.

The second fire or smoke detection circuit 20 is comprised, as shown in FIG. 1, of a remotely located fire/smoke detection circuit 22 that controls the operation of an integral sound activated switching circuit 24. The second fire or smoke detection circuit functions as a redundant fire or smoke detecting subsystem to thus increase the reliability of the system 10.

The remote fire/smoke detection circuit 22 is comprised, as shown within the dotted section of FIG. 1, of a remote audio alarm **22*a* and a set of detection and control circuits 22*b* that upon the detection of fire or smoke produce a control signal that controls the operation of the remote audio alarm. The circuit 22** may consist of any existing type of fire or smoke detecting device. The only constraint placed upon the device is that when the audio alarm is energized that it emit a substantial db sound level at an appropriate frequency.

The sound activated switching circuit 24 is comprised of a control and conditioning circuit **24*a* that controls the operation of a sound activated switch 24*b***.

The db sound level and appropriate frequency emitted by the remote alarm **22*a* is "picked-up" by a sound and frequency sensitive microphone 24*c* or transducer that forms a part of the control and conditioning circuit 24*a*. When the db sound signal is received, circuitry within the circuit 24*a* produces a closure signal that closes the sound activated switch 24*b*. The circuit 24*a* also includes the necessary circuitry to receive and set the sound level and frequency to a db level that will optionally close the sound activated switch 24*b*. The switch 24*b* is connected within the second fire or smoke detection circuit 20 to a properly conditioned signal that originates from the power source 18. Thus, when the switch 24*b*** closes, it produces the third SCR trigger signal.

The first, second, and third SCR trigger signals produced by the counter circuit **14*c*, the fire detection and control circuit 16*b* and the sound activated switch 24*b* respectively are applied to either a manually operated circuit selection switch 28, as shown in FIG. 1, or an automatic circuit selection device 30, as shown in FIG. 2. The switch 28 may consist of a toggle type switch or a rotary switch; in its simplized configuration it consists of a single-pole double-throw (SPDT) switch. As shown in FIG. 1, the SPDT switch 28 may also include a center-OFF position. When placed in this OFF position the load is disconnected and the SCR is prevented from initially latching. The OFF position can also be used during routine maintenance and/or inspection periods. In the preferred embodiment, the switch 28 is key operated and located within the enclosure 36**.

The first(1) contact of the switch 28 is connected to junction J1 where both the first and second SCR trigger signals converge. A pair of diodes 26 are included to prevent a signal feedback from one trigger signal output to the other. The third SCR trigger signal is connected to the second(2) contact of the switch 28. The output from the pole(P) of the switch is the final SCR trigger signal. This signal is routed through resistor R1 to the gate lead(G) of the SCR 32. The resistor R1 is a current limiter and also eliminates spurious noise signals that could inadvertently latch and turn-on the SCR.

In a second embodiment, as shown in FIG. 2, the three SCR trigger signals may be applied and switched automatically by an automatic circuit selection device 30 that functions on an "OR" gate. The device 30, which in the automatic mode replaces the switch 28, consists of an input circuit comprising a first diode **30*a* and a second diode 30*b*. The anode of diode 30*a* is connected to junction J1, which receives the first and second SCR trigger signals and the anode of diode 30*b* is connected to junction J2 which receives the third SCR trigger signal. The output of the device 30 is the final SCR trigger signal. At this output, the cathodes of both diodes are joined and connected through resistor R1 to junction J3** which attaches to the SCR gate lead(G).

The SCR 32 has its cathode, together with a pull-down resistor R2, connected to circuit ground and its anode connected to one side of the load circuit 34. The other side of the load is connected through the normally closed SCR reset switch 33 to the power source 18. When the SCR is latched (turned on) by the application of the final SCR trigger signal the load circuit 34 is energized causing the lamp **34*a* to flash and the audio alarm 34*b*** to emit a high db sound level.

In the preferred embodiment, the load consists of a bright xenon stroboscopic lamp **34*a* in parallel with an audible alarm 34*b*. As also shown in the load circuit of FIG. 1, other load devices may also be connected in parallel with loads 34*a*, 34*b* by means of a set of auxiliary load jacks 34*c*, 34*d***. One of these "other" load devices may be an automatic telephone dialer that is programmed to call the fire department when activated.

Once the system 10 is activated, it can only be deactivated by momentarily pressing on the SCR reset switch 33. When the switch is pressed, the switch contacts open which interrupts the current causing the SCR 32 to shut off. The SCR will remain off until the next final SCR trigger signal is generated and applied to the SCR gate lead(G). To prevent unauthorized shutoffs and general tampering with the system, the SCR reset switch 33 and the manually operated circuit selection switch 28 may be key operated with the key available to only authorized personnel.

The power source 18 is designed to provide all the voltages and currents required to operate the system 10. The power source, as shown schematically in FIG. 3, consists of a regulated d-c power supply that has an output of 24.0 V d-c and that operates from household utility power of 115 V a-c 60 Hz. The power source also incorporates a rechargeable 24 V d-c battery B1 that is kept charged by a battery charging circuit located within the power source 18. The battery becomes operational only if there is a failure in the household utility power.

Referring to FIG. 1, transformer T1 reduces the 115 V a-c household utility power to 27.5 V a-c. The a-c current is then rectified by a full-wave bridge rectifier CR1, filtered by capacitor C1, and then regulated by an electronic regulator IC1, such as a National LM 317 regulator. The output voltage is adjusted to 24 V d-c by potentiometer R1 and final filtering is provided by feedback resistor R2 and capacitor C2.

Diode CR2 located at the output, is an isolation diode that prevents the battery voltage from recharging back through the regulator IC1 when the household utility power is off. Resistor R3 is a current limiter that limits the battery charging current. Diode CR3 conducts around resistor R3 when the power source 18 is in the battery power mode. The potentiometer R1 is set to a voltage that float charges the battery when the power source 18 is operating on the household utility power.

Figure 5:
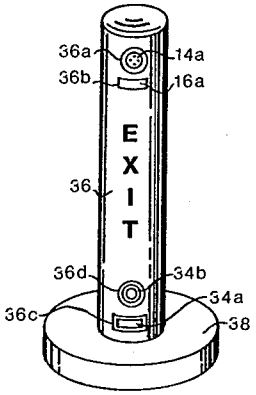
FIG. 5 is a perspective view of the elongated enclosure attached at its bottom to a weighted platform.
Figure 4:
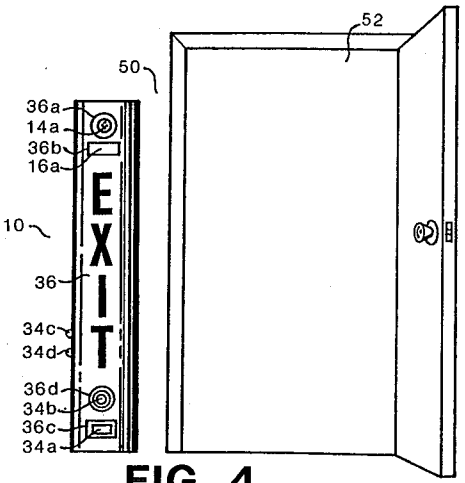
FIG. 4 is a front view of the elongated enclosure that houses the system attached to a wall alongside an exit door.
Figure 3:
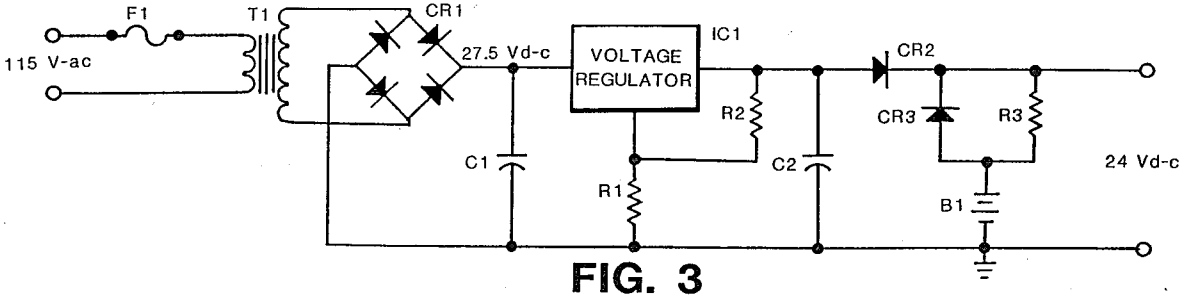
FIG. 3 is a schematic of the power source.

The final element described is the elongated enclosure 36 as shown in FIGS. 4 and 5. The preferred wall mounted enclosure is sized to fit against a wall 50 alongside an exit 52 such as a fire or an emergency exit. The enclosure is also designed to enclose all the elements of the system 10 with the exception of the remote fire/smoke detection circuit 22. A vertically mounted enclosure is shown in FIG. 4. However, if necessary, the enclosure can also be wall mounted in a horizontal position.

On the enclosure's upper section is located a pair of openings 36*a* and 36*b* that house the smoke detector 14*a* and fire detector 16*a* respectively. Alternatively, either or both of these detectors could be located away from the enclosure such as on the ceiling, to conform to local fire codes. In this case, the remote detectors would be hardwired to the enclosed comparator circuit 14*b* and fire detection and control circuit 16*b* respectively.

On the enclosure's lower section is located a pair of openings 36*c* and 36*d* that house the stroboscopic lamp 34*a* and audio alarm 34*b*. Along the side of the enclosure 36 is also located the pair of auxiliary load jacks 34*c*, 34*d* to where a auxiliary load such as the automatic telephone dialer can be connected.

The second embodiment of the enclosure 36 is identical to that described for the preferred embodiment with the exception that the bottom of the enclosure is attached to a weighted platform 38 as shown in FIG. 5. The weighted platform allows the enclosure to be placed in the middle of a floor, such as in a warehouse or on a structure facing a storefront window. In both embodiments, the word EXIT, as shown in both FIGS. 4 and 5, may also be printed on the front of the enclosure or the EXIT letters may be cutout and backlighted to further increase the safety and utility provided by the system 10.

While the invention has been described in complete detail and pictorially shown in the accompanying drawings it is not to be limited to such details, since many changes and modifications may be made to the invention without departing from the spirit and the scope thereof. For example, the photoelectric smoke detector 14*a* could be replaced with an ionization type detector should the application and location call for one. Additionally, a smaller battery powered system could be made for travelers or boaters. The system may also be coupled with ultrasonic or infrared motion detectors to also serve as a security device—in this application, a radio transmitter could be coupled to an automatic phone dialer that calls the police station. Hence, it is described to cover any and all modifications and forms which may come within the language and scope of the claims.

I claim:

1. A fire or smoke detection and alarm system comprising:

(a) a power source designed to provide all the voltages and currents required to operate said system wherein said power source further comprises:
  (1) a regulated d-c power supply operated from houshold utility power,
  (2) a rechargeable battery, and
  (3) a battery charging circuit operated by said regulated d-c power supply and connected to said rechargeable battery where said rechargeable battery powers said system when there is a failure in the household utility power, (b) a first fire or smoke detection circuit that produces a first SCR trigger signal when smoke is detected and a second SCR trigger signal when a fire is detected wherein said first circuit further comprises:
  (1) a smoke detection circuit further comprising:
    (A) a photoelectric smoke detector having a smoke chamber that incorporates a light source and a photodiode such that when smoke is detected, the light from the light source is reflected from the smoke blanket and received by the photodiode whereupon a detector signal is produced,
    (B) a comparator circuit that receives the detector signal and that is set to produce a comparator signal when a preset alarm level is attained,
    (C) a counter circuit that produces the first SCR trigger signal when a preset number of comparator signals are received within a specified time period,
  (2) a fire detection circuit further comprising:
    (A) a fire detector means that upon sensing a fire produces a fire detecting signal, and
    (B) a fire detection and control circuit that receives and converts the fire detecting signal from said fire detector means to the second SCR trigger signal, (c) a second fire or smoke detection circuit that produces a third SCR trigger signal when smoke or a fire is detected wherein said second circuit further comprises:
  (1) a remote fire/smoke detection circuit further comprising:
    (A) a remote audio alarm that when energized emits a substantial db sound level at an appropriate frequency,
    (B) a set of detection and control circuits that upon the detection of smoke or fire produce a control signal that energizes said remote audio alarm,
  (2) a sound activated switching circuit further comprising:
    (A) a sound activated switch that when closed produces the third SCR trigger signal, and
    (B) a control and conditioning circuit that upon the receipt of the sound level and frequency from said remote audio alarm a closure signal is produced that closes said sound activated switch, wherein said control and conditioning circuit includes circuitry and adjustments that allow the db sound level and frequency to be set to a level that will optimally close said sound activated switch, (d) a manually operated circuit selection switch that allows the first, second or third SCR trigger signals to be received and the final SCR trigger signal to be produced, where said manually operated circuit selection switch comprises a single-pole double-throw switch where the first contact is connected to the outputs of said smoke detection circuit and said fire detection circuit and where the second contact is connected to the output of said sound activated switch and where the pole is connected through a resistor to the SCR gate lead, (e) a load circuit, (f) an SCR reset switch, and (g) an SCR having its gate lead connected to the final SCR trigger signal, its cathode connected to circuit ground and its anode connected to one side of said load where other side of said load is connected through said SCR reset switch to said power source whereupon the application of the final SCR trigger signal, the SCR turnson, allowing the power from said power source to energize said load.

2. A fire or smoke detection and alarm system comprising:

(a) a power source designed to provide all the voltages and currents required to operate said system wherein said power source further comprises:
  (1) a regulated d-c power supply operated from household utility power,
  (2) a rechargeable battery, and
  (3) a battery charging circuit operated by said regulated d-c power supply and connected to said rechargeable battery where said rechargeable battery powers said system when there is a failure in the household utility power, (b) a first fire or smoke detection circuit that produces a first SCR trigger signal when smoke is detected and a second SCR trigger signal when a fire is detected wherein said first circuit further comprises:
  (1) a smoke detection circuit further comprising:
    (A) a photoelectric smoke detector having a smoke chamber that incorporates a light source and a photodiode such that when smoke is detected, the light from the light source is reflected from the smoke blanket and received by the photodiode whereupon a detector signal is produced,
    (B) a comparator circuit that receives the detector signal and that is set to produce a comparator signal when a preset alarm level is attained,
    (C) a counter circuit that produces the first SCR trigger signal when a preset number of comparator signals are received within a specified time period,
  (2) a fire detection circuit further comprising:
    (A) a fire detector means that upon sensing a fire produces a fire detecting signal, and
    (B) a fire detection and control circuit that receives and converts the fire detecting signal from said fire detector means to the second SCR trigger signal, (c) a second fire or smoke detection circuit that produces a third SCR trigger signal when smoke or a fire is detected wherein said second circuit further comprises:
  (1) a remote fire/smoke detection circuit further comprising:
    (A) a remote audio alarm that when energized emits a substantial db sound level at an appropriate frequency,
    (B) a set of detection and control circuits that upon the detection of smoke or fire produce a control signal that energizes said remote audio alarm,
  (2) a sound activated switching circuit further comprising:
    (A) a sound activated switch that when closed produces the third SCR trigger signal, and
    (B) a control and conditioning circuit that upon the receipt of the sound level and frequency from said remote audio alarm a closure signal is produced that closes said sound activated switch, where said control and conditioning circuit includes circuitry and adjustments that allow the db sound level and frequency to be set to a level that will optimally close said sound activated switch, (d) a manually operated circuit selection switch that allows the first, second or third SCR trigger signals to be received and the final SCR trigger signal to be produced, where said manually operated circuit selection switch comprises a single-pole double-throw switch where the first contact is connected to the outputs of said smoke detection circuit and said fire detection circuit and where the second contact is connected to the output of said sound activated switch and where the pole is connected through a resistor to the SCR gate lead and said single-pole double-throw switch includes a center-off position that when placed in the center-off position said load is disconnected and the SCR is prevented from initially latching, (e) a load circuit, (f) an SCR reset switch, and (g) an SCR having its gate lead connected to the final SCR trigger signal, its cathode connected to circuit ground and its anode connected to one side of said load where other side of said load is connected through said SCR reset switch to said power source whereupon the application of the final SCR trigger signal, the SCR turnson, allowing the power from said power source to energize said load.

* * * * *